United States Patent [19]

Carroll

[11] Patent Number: 4,698,152

[45] Date of Patent: Oct. 6, 1987

[54] OIL RECOVERY SYSTEMS

[76] Inventor: Noel Carroll, Sherbrooke Road, Sherbrooke, Victoria, Australia

[21] Appl. No.: 741,306

[22] PCT Filed: Aug. 3, 1984

[86] PCT No.: PCT/AU84/00151

§ 371 Date: Apr. 3, 1985

§ 102(e) Date: Apr. 3, 1985

[87] PCT Pub. No.: WO85/00851

PCT Pub. Date: Feb. 28, 1985

[30] Foreign Application Priority Data

Aug. 4, 1983 [AU] Australia ..... PG0664/83
Aug. 11, 1983 [AU] Australia ..... PG0778/83

[51] Int. Cl.[4] ..... B04C 5/14; B04C 5/081; B04C 5/13

[52] U.S. Cl. ..... 210/96.1; 210/195.1; 210/197; 210/259; 210/512.2

[58] Field of Search ..... 55/172–177; 210/96.1, 195.1, 197, 259, 512.2, 260; 209/144, 211

[56] References Cited

U.S. PATENT DOCUMENTS 2,882,995 4/1959 Smith ..... 55/174
3,208,201 9/1965 Oliver III ..... 55/175
3,764,008 10/1973 Darley et al. ..... 210/512.2
3,878,094 4/1975 Conley ..... 210/96.1
4,090,523 5/1978 Kelly, Jr. et al. ..... 210/512.2
4,190,523 2/1980 Niemeijer ..... 210/512.2
4,210,430 7/1980 Galow et al. ..... 210/512.2
4,350,596 9/1982 Kennedy, Jr. ..... 210/512.2

FOREIGN PATENT DOCUMENTS

83/03063 2/1983 Australia .
2130579 3/1972 France .

OTHER PUBLICATIONS

World Oil, vol. 190, No. 5, Apr. 1980, pp. 111–114, Houston, Texas, U.S.; E. E. Davies et al.
Chemie Ingenieur Tecknik, vol. 48, No. 3, Mar. 1976, Seiten 177, 187–188, Weinheim, DE; M. Bohnet.

*Primary Examiner*—Frank Sever

[57] ABSTRACT

An oil recovery system comprises a first separator preferably in the form of a three-stage "knock-out" tank (54) connected to receive crude oil from an oil-well (50). Water contaminated with oil is lead from the first separator to the inlet manifold (48) of a second separator bank (10) preferably consisting of one or more cyclone separators which separates the inlet mixture into separate water and oil components. The outlet pipe (35) for the separated water component selectively discharges to an outlet (82) or recycled through the cyclone separated; preferably in accordance with the degree of oil contamination of the separated water component.

7 Claims, 3 Drawing Figures

OIL RECOVERY SYSTEMS

The present invention relates to oil recovery systems.

According to the present invention there is provided an oil recovery system including an inlet for crude oil from a well, a first separator connected to receive said crude oil admitted to said inlet and for separation of the crude oil into gas-containing, oil-containing and water-containing components, said first separator having a first outlet for said gas-containing component, a second outlet for said oil-containing component and a third outlet for said water-containing component, a second separator having an inlet connected to receive said water-containing component from said third outlet and arranged for separating said water-containing component into a water component and an oil component, said second separator having a fourth outlet for said separated oil component and a fifth outlet for said water component, a recycling line selectively couplable between the fifth outlet and the inlet to said second separator for recycling said water component back to the second separator, and means for controlling the selective coupling of the recycling line to the fifth outlet to effect either return of said water component to the second separator or to discharge the water component to a sixth outlet.

Preferably, the control means includes monitor means for monitoring contaminant oil content of said water component from the second separator and operable to return the water component, with contaminant oil, to the second separator inlet in the event that the contaminant oil content is above a predetermined level and to pass the water component to the sixth outlet in the event that it is below said predetermined level.

Preferably the second separator is a cyclone separator or a bank of cyclone separators. In the latter case, the second separator may include cyclone separators connected in parallel. Preferably, in that event, said monitor means is arranged to monitor the water component from one only of the bank of cyclone separators.

According to another aspect, there is provided a method of recovering oil, comprising feeding crude oil from a well to a first separator in which the crude oil separates into gas-containing, oil-containing, and water-containing components, feeding the water-containing component to a second separator of cyclone type to separate the component into oil and water, and selectively passing the separated water to discharge or recycling the separated water through the second separator.

The invention also provides, in combination, a bank of cyclone separators including a line connecting the inlets of the separators together, a line connecting together the separator outlets for one component to be separated, and a line connecting together the separator outlets for the other component to be separated.

Embodiments of the invention will now be described by way of example with reference to the accompanying drawings in which.

Figure 1:
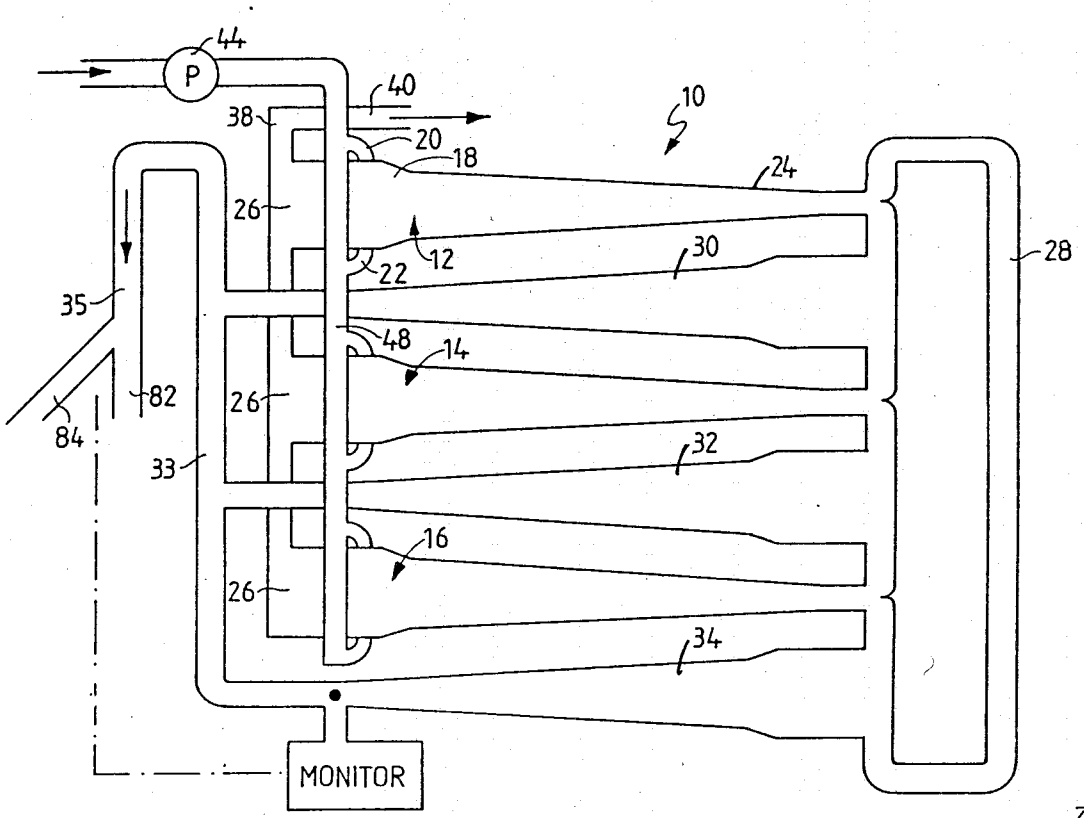
FIG. 1 is a diagram showing the manner of interconnection of cyclone separators in a bank of cyclone separators in accordance with an embodiment of the invention.

In FIG. 1, a bank 10 of three cyclone separators 12, 14, 16 is shown. The cyclone separators 12, 14, 16 may be substantially identical and may be of the form described in the complete specification of Australian patent application No. 12421/83.

The cyclone separators 12, 14, 16 each have a generally cylindrical first portion 18 with two tangential inlets 20, 22, portion 18 leading to a narrowed "underflow" outlet 24 at one end of the separator for outlet of a first component of a liquid mixture to be separated, a second "overflow" outlet 26 being provided at the other end of the separator for outlet of the other component of the liquid mixture. The outlets 24 are connected together in parallel by a line 28 and lines 30, 32 and 34 are provided connected to line 28 and thence to a common outlet manifold 33. Manifold 33 is connected to an outlet pipe 35. The outlets 26 are likewise connected to a common outlet manifold 38 which leads to a second outlet 40. The arrangement shown is intended for separating of oil and water components from a mixture containing oil and water. The mixture is admitted such as by use of a pump 44 to the common inlets 20, 22 of each separator, via an inlet manifold 48. By cyclone action, the oil components appear at the outlets 26 and are passed to manifold 38 and thence to outlet 40. Similarly, the water components are delivered through the outlets 24, line 28 and lines 30, 32, 34 to manifold 33 and thence to outlet pipe 35.

Figure 2:
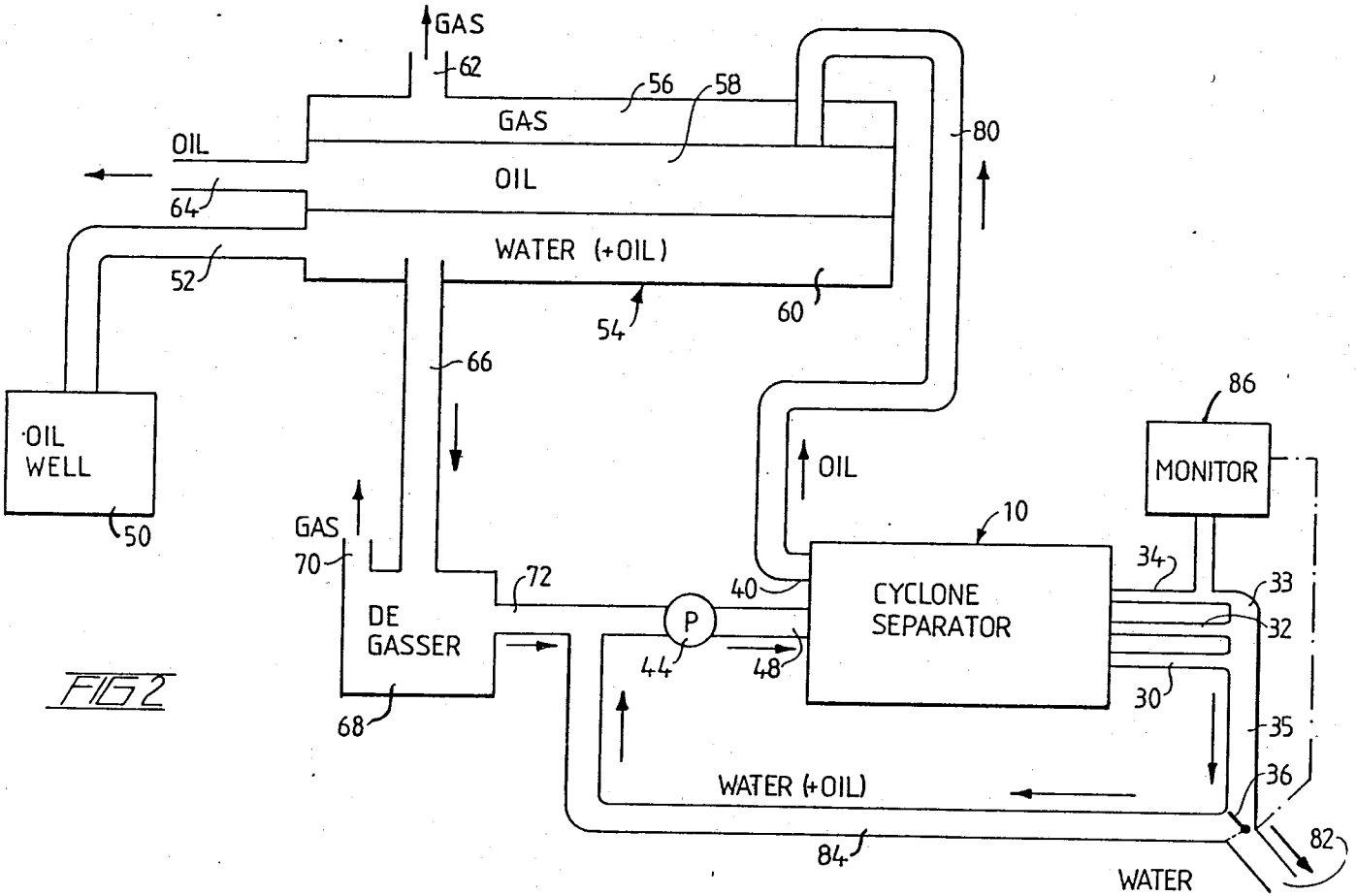
FIG. 2 is a diagram showing an oil recovery system constructed in accordance with an embodiment of the invention.

The system shown in FIG. 2 is arranged for use in conjunction with an oil-well 50. Crude oil from the oil-well is taken via the usual outlet pipe 52 to a three stage "knockout" tank 54 in accordance with conventional practice, whereupon the crude oil separates into layers the upper of which predominately comprises gas 56, the intermediate of which predominately oil 58 and the lower of which is a liquid 60 which is predominately water but which may have oil contaminant therein. The gas is taken off via a line 62 for further processing and eventual use whilst the oil is likewise taken off via a line 64 for further processing and eventual use. The liquid 60 is taken via a line 66 to a degasifier 68 of conventional form which operates to remove trapped gas therefrom, the gas being removed via an outlet 70. The degasifier liquid in degasifier 68 is taken via a line 72 to the pump 44 associated with the separator bank 10 as described previously. As described previously also, the pump 44 is connected to the inlet manifold 48 of the bank 10.

The outlet 40 from the bank 10 is taken via a line 80 to communicate with the knockout tank 54. The manifold 33 is, as described, connected to the outlet pipe 35 and this terminates at a valve 36 selectively operable to connect line 35 either to an outlet 82 from the system or to a return line 84. Line 84 leads, from valve 36 to communicate with line 72 intermediate degasifier 68 and pump 44. A suitable oil monitor 86 of known type is provided connected to one line 34 of the separator 10, being one of the lines which communicates between line 28 and manifold 33. Monitor 86 monitors the oil content of liquid passing along line 34 and is operatively connected to valve 36 to control the valve in a manner described later.

In use, liquid 60 in knockout tank 54 after passing through the degasifier 68 is pumped into the cyclone separator bank 10 for separation into water and oil components. The oil components are returned to the tank 54 as described via line 80. A separated component which predominately comprises water appears as manifold 33 and is delivered to pipe 35. Monitor 68 is so arranged that in the event that there is no oil content in the component passing along pipe 35, the valve 36 is conditioned to block flow into line 84 and to cause all of the liquid passing from lines 32, 30, 34 to manifold 33 and thence to line 35 to be passed out outlet 82. The monitor is operative to maintain this decoupling of line 84 and the coupling of pipe 35 and outlet 82 subject to the condition that the monitored oil content in the component passing along line 34 does not exceed a predetermined level. On this predetermined level being exceeded, monitor 86 operates to condition valve 36 to a condition at which outlet 82 is blocked and the component liquid passes down pipe 35 along line 84 back to line 72 from whence it is pumped by pump 44 back into manifold 48 and again through the separator bank 10. This recirculation of liquid around the loop comprising the separator bank 10, the pipe 35, line 84, line 72 and pump 44 back to the separator bank is continued until such time as the oil content as monitored at line 34 falls to the predetermined level whereupon outlet of water to outlet 82 is again resumed.

The arrangement described above permits the recovery of additional oil content from the liquid 60, which oil would not be recovered if the liquid 60 were merely discharged. Furthermore, the arrangement has the advantage that the discharge at outlet 82 may be arranged to be of relatively pure water thereby avoiding pollution problems which would otherwise exist if a substantial oil content were present in the discharged water.

The monitor 86 may be of known type particularly of the kind having mechanism for physically working the liquid to be monitored to reduce particle size of contaminants therein.

The bank 10 may be formed differently to that described in relation to FIG. 1. More particularly, the lines 30, 32, 34 may be replaced by respective further separators like separators 12, 14, 16 each arranged to receive liquid at the inlets 20, 22 thereof from the line 28. The further separators would have the overflow outlets 26 connected to manifold 38 and outlet 40 whilst the under flow outlets 24 would be connected to the manifold 33.

Figure 3:
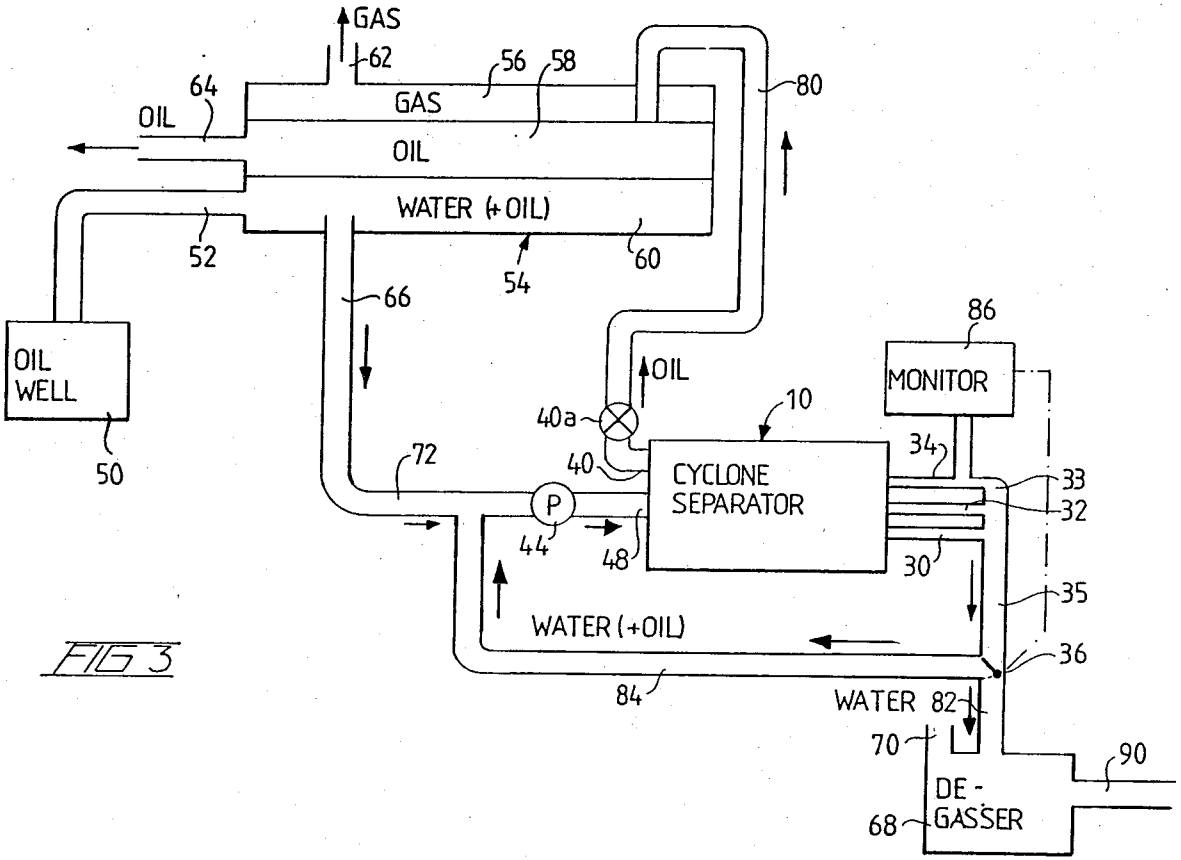
FIG. 3 is a diagram like FIG. 2 but illustrating a modification of the system of FIG. 2.

In FIG. 3 there is shown a system similar to that of FIG. 2. In FIGS. 2 and 3, like reference numerals denote like components and the following description is confined to matters where there are differences between the two systems. More particularly, in the system of FIG. 3, the degasifier 68 is not positioned in the fluid flow path from tank 54 to pump 44 but is instead fitted to the outlet 82. Thus, the degasifier 68 receives separated water component from the manifold 35 and operates to discharge gas from the water via outlet 70 and to discharge the degasified water via an outlet 90. In this case, the lines 66 and 62 join so that liquid 60 is passed directly from tank 54 to separator bank 10 via pump 44. The system of FIG. 3 also includes a valve **40*a* in line 80 which is operable to variably restrict flow through the line to control pressure at the outlet 40 of the bank 10, for effecting variation of the "split ratio" of the bank 10. The split ratio is the ratio of the quantity of liquid appearing at the outlet 40 of bank 10 per unit time to the quantity of liquid delivered to the bank 10 per unit time via inlet manifold 48**. Normally this ratio is controlled to be a small value such as 1%.

Although the systems of FIGS. 2 and 3 incorporate a de-gasser (as shown at 68), the de-gasser may be omitted, if desired.

The described construction has been advanced merely by way of explanation and many modifications may be made thereto without departing from the spirit and scope of the invention which includes every novel feature and combination of novel features herein disclosed.

I claim:

1. An oil recovery system including: an inlet for crude oil from a well; a first separator in the form of a knock-out tank connected to receive said crude oil admitted to said inlet and for separation of the crude oil into gas-containing, oil-containing and water-containing components, said first separator having a first outlet for said gas-containing component, a second outlet for said oil-containing component and a third outlet for said water-containing component; a second separator of the cyclone type having an inlet connected to receive said water-containing component from said third outlet and arranged for separating said water-containing component into a water component and an oil component, said second separator having a fourth outlet for said separated oil component and a fifth outlet for said water component, said fourth and fifth outlets being separate from said inlet of said second cyclone separator; a recycling line selectively couplable between the fifth outlet and the inlet to said second separator for recycling said water component back to the second separator; valve means operatively interposed between said fifth outlet and said recycling line and a sixth outlet, and operative in one position to couple the fifth outlet to the sixth outlet, and in a second position to couple the fifth outlet to the recycling line; control means for directing said water component from said fifth outlet to said sixth outlet when purity of said water component is above a predetermined value, and for directing said water component from said fifth outlet to said inlet of the second separator when the purity of said water component is below said predetermined valve, said recycling line being for controlling the selective coupling of the recycling line to the fifth outlet by controlling said valve means to effect either return of said water component to the second separator or to discharge the water component to the sixth outlet; and a further line connected to said fourth outlet of said second separator and opening to the interior of said knock-out tank for returning oil separated by the second separator means to the knock-out tank.

2. A system according to claim 1, wherein said control means comprises monitor means for monitoring the contaminant oil content of said water component from the second separator and operable to effect return of the water component, with contaminant oil, to the second separator inlet in the event that the contaminant oil content is above a predetermined level and to effect passage of the water component to the sixth outlet in the event that it is below said predetermined level.

3. A system according to claim 2, wherein the second separator comprises a bank of cyclone separators, the cyclone separators are connected in parallel, and wherein the monitor means is arranged to monitor the water component discharged from one only of the parallel connected separators.

4. A system according to claim 1, further comprising a de-gasser between the third outlet and the inlet for the second separator.

5. A system according to claim 1, further comprising a de-gasser connected to the sixth outlet.

6. A system according to claim 1, wherein the second separator comprises a bank of cyclone separators.

7. A system according to claim 6, wherein the cyclone separators are connected in parallel.

* * * * *

UNITED STATES PATENT AND TRADEMARK OFFICE

CERTIFICATE OF CORRECTION

PATENT NO. : 4,698,152

DATED : October 6, 1987

INVENTOR(S) : Noel Carroll

It is certified that error appears in the above-identified patent and that said Letters Patent is hereby corrected as shown below:

Column 4, lines 35 and 36, Claim 18, "said recycling line being"

should read -- said control means being --.

Signed and Sealed this

Twenty-first Day of November, 1989

*Attest:*

JEFFREY M. SAMUELS

*Attesting Officer* *Acting Commissioner of Patents and Trademarks*